US010295234B2

(12) United States Patent
Su

(10) Patent No.: US 10,295,234 B2
(45) Date of Patent: May 21, 2019

(54) HEAT EXCHANGE DEVICE SUITABLE FOR LOW PRESSURE REFRIGERANT

(71) Applicant: Johnson Controls Technology Company, Plymouth, MI (US)

(72) Inventor: Xiuping Su, Wuxi (CN)

(73) Assignees: Johnson Controls Technology Company, Auburn Hills, MI (US); York (Wuxi) Air Conditioning and Refrigeration Co., Ltd., Wuxi, JS (CN)

( * ) Notice: Subject to any disclaimer, the term of this patent is extended or adjusted under 35 U.S.C. 154(b) by 44 days.

(21) Appl. No.: 15/436,164

(22) Filed: Feb. 17, 2017

(65) Prior Publication Data

US 2017/0241682 A1 Aug. 24, 2017

(30) Foreign Application Priority Data

Feb. 19, 2016 (CN) ..... 2016 1 0095118
Feb. 19, 2016 (CN) ..... 2016 2 0131265 U

(51) Int. Cl.

| | |
|---|---|
| ***F28D 5/02*** | (2006.01) |
| ***F25B 39/00*** | (2006.01) |
| ***F28D 7/00*** | (2006.01) |
| ***F28D 7/16*** | (2006.01) |
| *F28D 21/00* | (2006.01) |

(52) U.S. Cl.

CPC ..... *F25B 39/00* (2013.01); *F28D 5/02* (2013.01); *F28D 7/0066* (2013.01); *F28D 7/1607* (2013.01); *F25B 2339/0242* (2013.01); *F25B 2339/046* (2013.01); *F25B 2339/047* (2013.01); *F25B 2500/18* (2013.01); *F28D 2021/0071* (2013.01)

(58) Field of Classification Search

CPC ..... F25B 39/00; F25B 2500/18; F25B 2339/047; F25B 2339/0242; F25B 2339/046; F28D 7/0066; F28D 5/02; F28D 7/1607; F28D 2021/0071

See application file for complete search history.

(56) References Cited

U.S. PATENT DOCUMENTS

2009/0178789 A1* 7/2009 Luo ..... F25B 39/04 165/157
2009/0242178 A1* 10/2009 Al-Anizi ..... F28D 7/1607 165/134.1
2013/0277018 A1* 10/2013 Numata ..... F28D 3/02 165/157
2015/0007604 A1* 1/2015 Hu ..... F28F 9/028 62/507

* cited by examiner

*Primary Examiner* — Ana M Vazquez
(74) *Attorney, Agent, or Firm* — Fletcher Yoder, P.C.

(57) ABSTRACT

A heat exchange device includes a first heat exchange unit having a first condenser tube bundle disposed within a first cylinder of the first heat exchange unit and a second heat exchange unit having a refrigerant dispenser disposed in a second cylinder of the second heat exchange unit, where a first refrigerant outlet of the first heat exchange unit is in fluid communication with a first refrigerant inlet of the second heat exchange unit through a throttling device, the refrigerant dispenser extends along an axial direction of the second cylinder to form a chamber within the second cylinder, the chamber includes an upper portion and a lower portion, a second condenser tube bundle is disposed in the upper portion of the chamber, and an evaporation tube bundle is disposed in the lower portion of the chamber.

19 Claims, 5 Drawing Sheets

HEAT EXCHANGE DEVICE SUITABLE FOR LOW PRESSURE REFRIGERANT

CROSS-REFERENCE TO RELATED APPLICATION

This application claims priority to and the benefit of Chinese Patent Application No. 201610095118.6, entitled "HEAT EXCHANGE DEVICE SUITABLE FOR LOW PRESSURE REFRIGERANT," filed Feb. 19, 2016, and Chinese Patent Application No. 201620131265.X, entitled "HEAT EXCHANGE DEVICE SUITABLE FOR LOW PRESSURE REFRIGERANT," filed Feb. 19, 2016, both of which are herein incorporated by reference in their entireties.

BACKGROUND

The present disclosure relates to heating, ventilating, air conditioning, and refrigeration (HVAC&R) systems, and specifically, to a heat exchange device for a low pressure refrigerant.

Falling-film evaporators have been applied to HVAC&R systems to enhance heat transfer efficiency and reduce refrigerant charge. Unfortunately, typical falling-film evaporators may include a refrigerant dispenser that causes refrigerant to incur a relatively high pressure differential due to typical falling-film evaporators used in systems that utilize relatively high pressure refrigerants. Therefore, a heat exchange device which is suitable for a low pressure refrigerant environment is desired.

SUMMARY

Embodiments of the present disclosure are directed to a heat exchange device for a low pressure refrigerant. The heat exchange device includes a first heat exchange unit and a second heat exchange unit. A first refrigerant outlet of the first heat exchange unit is in fluid communication with a first refrigerant inlet of the second heat exchange unit through a throttling device, the first heat exchange unit has a first condenser tube bundle disposed in a first cylinder of the first heat exchange unit, a second cylinder of the second heat exchange unit includes a refrigerant dispenser extending along an axial direction of the second cylinder to form a chamber within the second cylinder having an upper portion and a lower portion, a second condenser tube bundle is disposed in the upper portion of the chamber, and an evaporation tube bundle is disposed in the lower portion of the chamber.

In some embodiments, the first heat exchange unit includes a second refrigerant inlet and the first refrigerant outlet; and the second heat exchange unit includes the first refrigerant inlet and a second refrigerant outlet.

In some embodiments, a first impingement plate is disposed between the first condenser tube bundle of the first heat exchange unit and the second refrigerant inlet; and a second impingement plate is disposed between the second condenser tube bundle of the second heat exchange unit and the first refrigerant inlet.

In some embodiments, a gas-returning liquid baffle is disposed in the second cylinder of the second heat exchange unit and partitions the second cylinder into the chamber and a gas returning chamber along the axial direction of the cylinder, the second refrigerant outlet is in fluid communication with the gas returning chamber, and the first refrigerant inlet is in fluid communication with the chamber.

In some embodiments, the first heat exchange unit further includes first tube plates, a first front water tank, and a first rear water tank that are disposed at first ends of the first cylinder of the first heat exchange unit, the first front water tank is provided with a first inlet and a first outlet, and a first pass partition plate is disposed within the first front water tank to partition the first inlet from the first outlet.

In some embodiments, the second heat exchange unit includes second tube plates, a second front water tank, and a second rear water tank that are disposed at second ends of the second cylinder of the second heat exchange unit, the second front water tank is provided with a second inlet, a chilled fluid inlet, and a chilled fluid outlet, a front water tank partition plate that blocks cooling fluid from mixing with chilled fluid is disposed between the second inlet and the chilled fluid outlet, a second pass partition plate is disposed between the chilled fluid inlet and the chilled fluid outlet, and a rear water tank partition plate that blocks the cooling fluid from mixing with the chilled fluid is disposed within the second rear water tank.

In some embodiments, the second inlet of the second heat exchange unit is in fluid communication with the first inlet of the first heat exchange unit through a conduit, and the second rear water tank of the second heat exchange unit is further provided with a return in fluid communication with the first rear water tank of the first heat exchange unit.

In another aspect, the present disclosure relates to a method for using a heat exchange device that includes receiving a refrigerant vapor discharged from a compressor outlet port in a first cylinder of a first heat exchange unit via a first refrigerant inlet, condensing the refrigerant vapor into a refrigerant liquid after passing the refrigerant vapor over a first condenser tube bundle disposed in the first cylinder of the first heat exchange unit, directing the refrigerant liquid through a first refrigerant outlet of the first heat exchange unit into a connection conduit coupled to a second refrigerant inlet of a second heat exchange unit, receiving the refrigerant liquid in a second cylinder of the second heat exchange unit via the second refrigerant inlet, condensing the refrigerant liquid into a saturated refrigerant liquid after passing the refrigerant liquid over a second condenser tube bundle of the second heat exchange unit, directing the saturated refrigerant liquid through a refrigerant dispenser disposed within the second cylinder of the second heat exchange unit, such that the saturated refrigerant liquid becomes a two-phase refrigerant, and evaporating the two-phase refrigerant into the refrigerant vapor after passing the two-phase refrigerant over an evaporation tube bundles disposed in the second cylinder of the second heat exchange unit.

Embodiments of the present disclosure also relate to a heat exchange device that includes a first heat exchange unit having a first condenser tube bundle and a first impingement plate disposed within a first cylinder of the first heat exchange unit, where the first impingement plate is disposed in the first cylinder proximate to a first refrigerant inlet and a second heat exchange unit having a refrigerant dispenser, a second condenser tube bundle, and an evaporation tube bundle disposed in a second cylinder of the second heat exchange unit, where a first refrigerant outlet of the first heat exchange unit is in fluid communication with a second refrigerant inlet of the second heat exchange unit through a throttling device, and the second impingement plate is disposed in the second cylinder proximate to the second refrigerant inlet.

Embodiments of the present disclosure relate to a double-tube bundle heat exchange device suitable for a low pressure refrigerant, which may have a less complex structure, higher efficiency, and/or reduced refrigerant charge.

DRAWINGS

Figure 2:
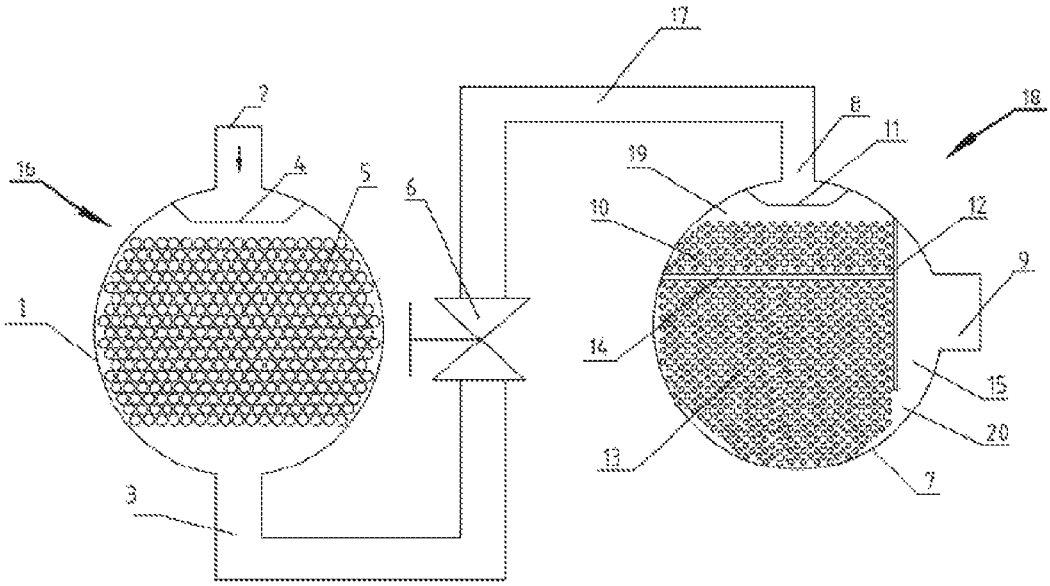
FIG. 2 is a schematic of an embodiment of a heat exchange device that may be utilized with a low pressure refrigerant, in accordance with an embodiment of the present disclosure.
Figure 5:
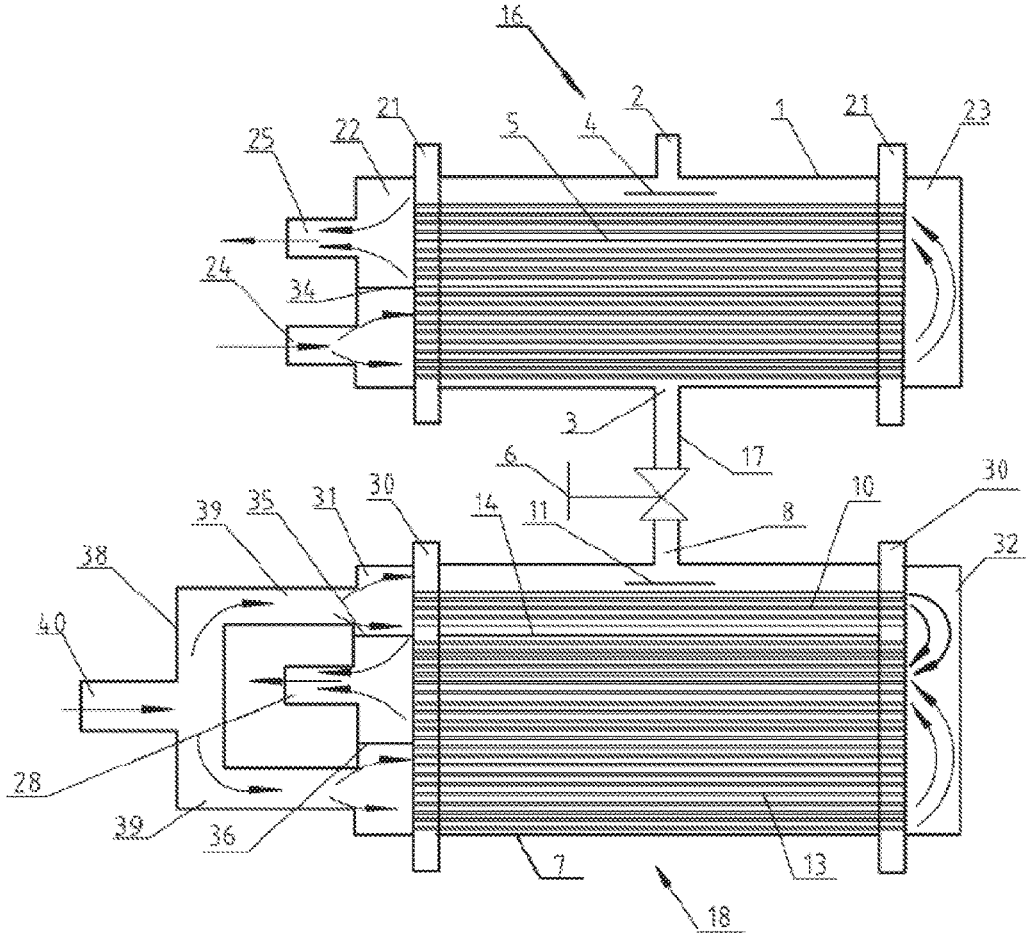
Figure 6:
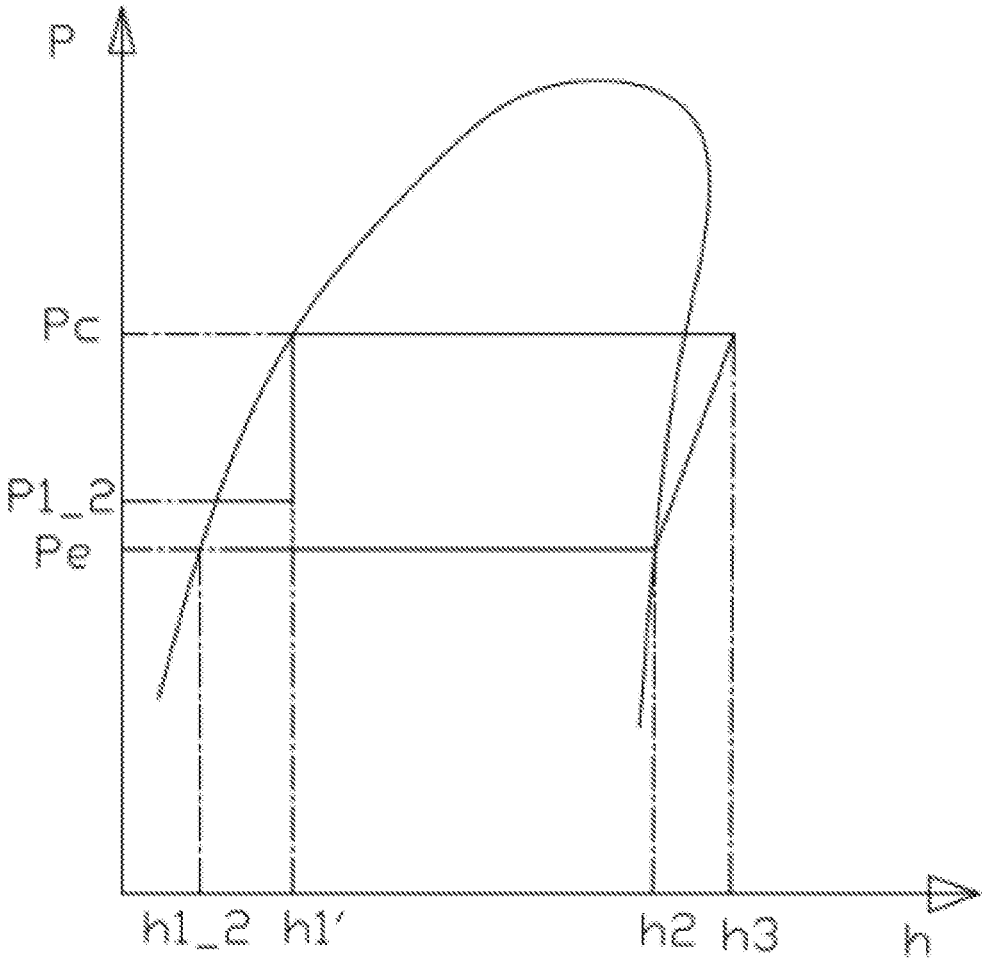

FIG. 5 schematic of an embodiment of a two-flow path water circulation loop that may be utilized with the heat exchange device of FIG. 2, in accordance with an embodiment of the present disclosure; and FIG. 6 is a chart of a pressure-enthalpy diagram of the heat exchange device that utilizes the two-flow path water circulation loop of FIG. 5, in accordance with an embodiment of the present disclosure.

DETAILED DESCRIPTION

Figure 1:
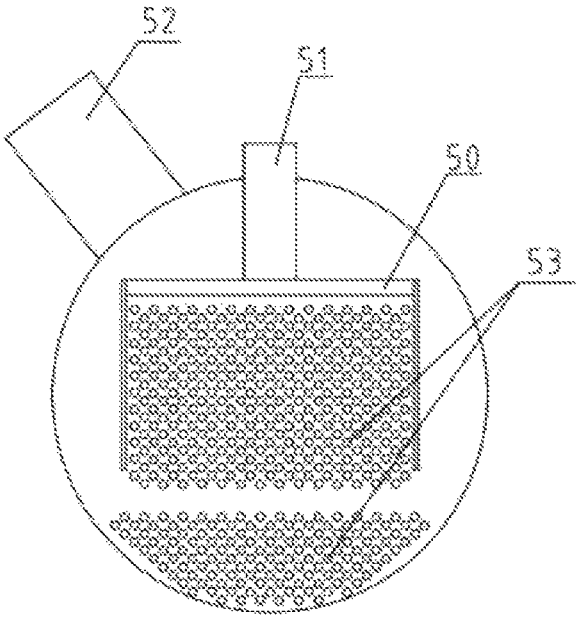
FIG. 1 PRIOR ART
FIG. 1 is a schematic illustration of a conventional falling-film evaporator.

A typical falling-film evaporator configured to utilize a relatively high pressure refrigerant (e.g., R134a) may generally include a structure as shown in FIG. 1. For example, as shown in the illustrated embodiment of FIG. 1, the falling-film evaporator may include an evaporator outlet pipe 52, a liquid inlet pipe 51, a refrigerant dispenser 50, and/or evaporation tube bundles 53. In some embodiments, a gas-liquid refrigerant (e.g., two-phase refrigerant) may pass through the liquid inlet pipe 51 and enter the evaporator after passing through the refrigerant dispenser 50. Once the refrigerant enters the evaporator, refrigerant droplets (e.g., liquid refrigerant) may fall onto the evaporation tube bundles 53, such that the refrigerant droplets absorb heat from fluid in the evaporation tube bundles 53 and evaporate into refrigerant vapor. The generated refrigerant vapor is then discharged via the evaporator outlet pipe 52, where it may enter a compressor.

The refrigerant dispenser 50 may enhance uniform distribution of the refrigerant onto the evaporation tube bundles 53. However, typical falling-film evaporators may be configured to utilize a relatively high pressure refrigerant (e.g., R134a). Therefore, the refrigerant dispenser 50 may include a pressure difference that accommodates the high pressure refrigerant to ultimately direct the refrigerant over the evaporation tube bundles 53. For example, in some cases, the pressure difference across the refrigerant dispenser may be up to 150 kilopascals (kPa) or up to 300 kPa.

In accordance with embodiments of the present disclosure, the refrigeration system may include a low pressure refrigerant, such as R1233zd(E). Low pressure refrigerants are becoming more desirable because they are generally more environmentally friendly and efficient than high pressure refrigerants. Table 1 shows a comparison between respective evaporation pressures and condensation pressures of R1233zd(E) and R134a under typical refrigeration working conditions (with an evaporation temperature of 5° C. and a condensation temperature of 36.7° C.). As shown, a difference between the evaporation pressure (Pevap, kPA) and the condensation pressure (Pcond, kPa) of R1233zd(E) is 23.1% of the pressure difference of R134a. Accordingly, the refrigerant dispenser 50 may be configured to accommodate the large pressure difference of relatively high pressure refrigerants to distribute the high pressure refrigerants over the evaporation tube bundles 53. However, such a pressure difference may be too high for low pressure refrigerants, such that the refrigerant dispenser 50 may not sufficiently distribute low pressure refrigerant over the evaporation tube bundles 53 (e.g., the low pressure refrigerant may simply fall through the refrigerant dispenser 50 without dispersing towards ends of the refrigerant dispenser 50).

TABLE 1

Typical refrigeration operating conditions

| | R1233zd(E) | R134a | R1233zd(E) vs R134a |
|---|---|---|---|
| Tevap | 5 | 5 | |
| Tcond | 36.7 | 36.7 | |
| Pevap, kPa | 59.44 | 349.66 | 17.0% |
| Pcond, kPa | 193.65 | 929.57 | 20.8% |
| Compression Ratio | 3.26 | 2.66 | 122.6% |
| Pressure Difference, kPa | 134.21 | 579.91 | 23.1% |

FIG. 2 is a schematic of a heat exchange device that may utilize a low pressure refrigerant. As shown in the illustrated embodiment of FIG. 2, the heat exchange device may include a first heat exchange unit 16, a throttling device 6, a connection conduit 17, and/or a second heat exchange unit 18. The throttling device 6 may be disposed between the first heat exchange unit 16 and the second heat exchange unit 18 which are connected through the connection conduit 17 (e.g., the throttling device is disposed along the connection conduit 17). In some embodiments, the first heat exchange unit 16 includes a cylinder 1 having a first heat exchange unit refrigerant inlet 2 and a first heat exchange unit refrigerant outlet 3. Additionally, the first heat exchange unit may include an impingement plate 4 and a condenser tube bundle 5 disposed within the cylinder 1. Similarly, the second heat exchange unit 18 may include a cylinder 7 having a second heat exchange unit refrigerant inlet 8 and a second heat exchange unit refrigerant outlet 9. Additionally, the second heat exchange unit 18 may include an impingement plate 11, a liquid baffle 12, and/or a refrigerant dispenser 14 disposed within the cylinder 7.

In some embodiments, the liquid baffle 12 may partition an interior of the cylinder 7 into a gas returning chamber 15 and a piping chamber 19 along an axial direction of the cylinder 7. The gas returning chamber 15 may be in fluid communication with the piping chamber 19 through an opening 20 provided at a lower portion of the liquid baffle 12. Further, the second heat exchange unit refrigerant inlet 8 may be in fluid communication with the piping chamber 19 and the second heat exchange unit refrigerant outlet 9 may be in fluid communication with the gas returning chamber 15. As shown in the illustrated embodiment of FIG. 2, the refrigerant dispenser 14 is disposed in the piping chamber 19 and partitions the piping chamber 19 into upper and lower portions along the axial direction of the cylinder 7. The upper portion of the piping chamber 19 formed by the refrigerant dispenser 14 may be provided with a condenser tube bundle 10. Additionally, the lower portion of the piping chamber 19 formed by the refrigerant dispenser 14 may be provided with a falling-film evaporation tube bundle 13.

Embodiment 1

Figure 3:
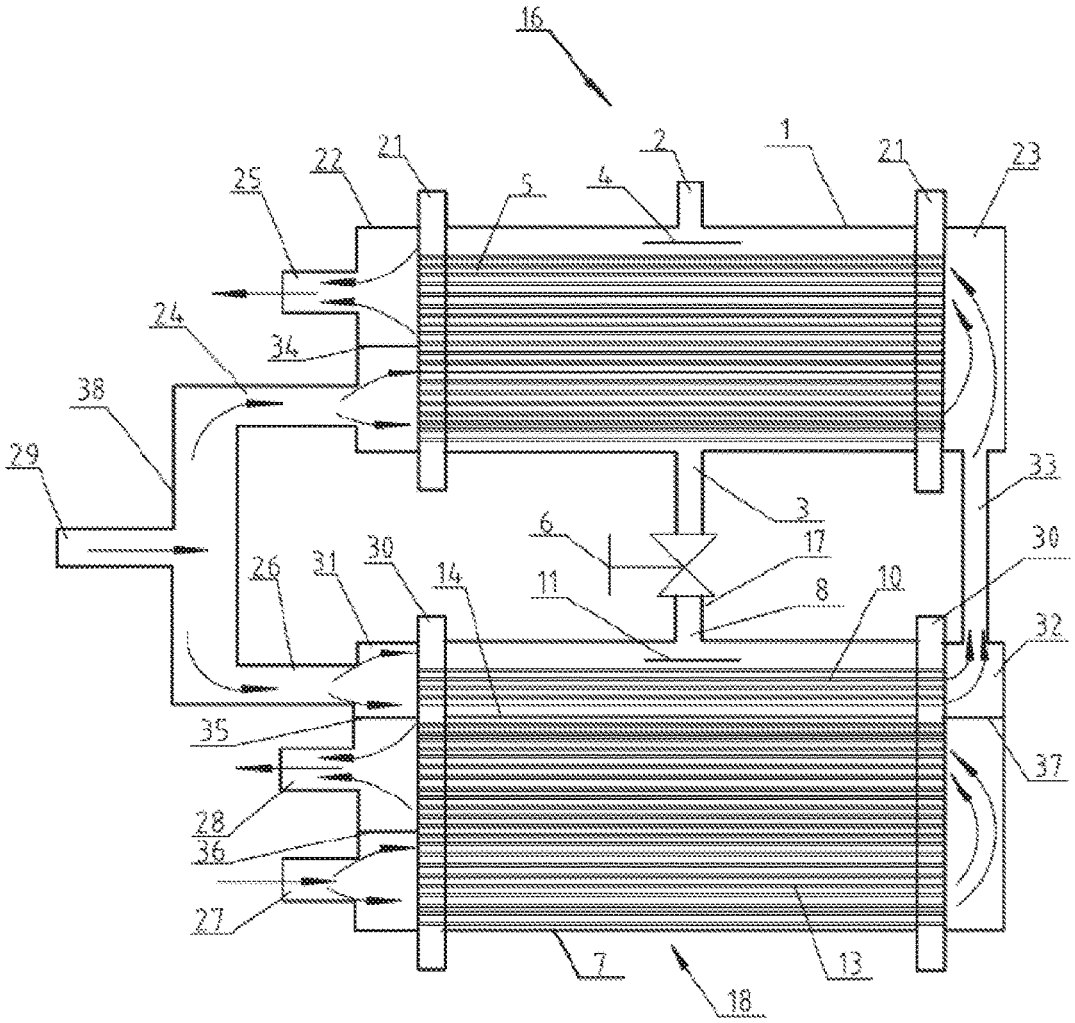
FIG. 3 is schematic of an embodiment of a two-flow path water circulation loop that may be utilized with the heat exchange device of FIG. 2, in accordance with an embodiment of the present disclosure.

FIG. 3 is a schematic of an embodiment of a two-flow path water circulation loop. As shown in the illustrated embodiment of FIG. 3, the first heat exchange unit 16 further includes tube plates 21, a front water tank 22, and a rear water tank 23 that are disposed at ends of the cylinder 1 of the first heat exchange unit 16. The front water tank 22 is provided with an inlet 24 and an outlet 25. A pass partition plate 34 is disposed inside the front water tank 22 to partition the inlet 24 from the outlet 25 and to enable cooling fluid to make two passes through the first heat exchange unit 16.

Further, the second heat exchange unit 18 may include tube plates 30, a front water tank 31, and a rear water tank 32 that are disposed at ends of the cylinder 7 of the second heat exchange unit 18. The front water tank 31 is provided with a cooling fluid inlet 26, a chilled fluid inlet 27, and a chilled fluid outlet 28. The inlet 26 may be in fluid communication with the inlet 24 of the first heat exchange unit 16 through a conduit 38, which may be in fluid communication with a cooling fluid inlet 29. The second heat exchange unit 18 may further include a partition plate 35 disposed between the inlet 26 and the chilled fluid outlet 28 to block cooling fluid from mixing with chilled fluid in the front water tank 31. Additionally, a pass partition plate 36 may be disposed between the chilled fluid inlet 27 and the chilled fluid outlet 28, such that the chilled fluid may make two passes through the second heat exchange unit 18. A partition plate 37 is disposed inside the rear water tank 32 and also blocks the cooling fluid from mixing with the chilled fluid in the rear water tank 32. The rear water tank 32 is further provided with a cooling fluid return 33, which may be in fluid communication with the rear water tank 23 of the first heat exchange unit 16. Accordingly, cooling fluid that enters the second heat exchange unit 18 may be directed through the first heat exchange unit 16 after passing through the second heat exchange unit 18.

For example, the cooling fluid flowing through the cooling fluid inlet 29 may be divided into two paths via the conduit 38. The first path of the cooling fluid may direct the cooling fluid from the inlet 24, through a first pass of a condenser tube bundle 5 of the first heat exchange unit 16, and into the rear water tank 23 of the first heat exchange unit 16. The first path may then direct the cooling fluid from the rear water tank 23 of the first heat exchange unit 16, through a second pass of the condenser tube bundle 5, and back into the front water tank 22 to the outlet 25. While flowing through the first and second passes of the condenser tube bundle 5, the cooling fluid may be in a heat exchange relationship with another fluid in the cylinder 1.

The second path of the cooling fluid may direct the cooling fluid from the cooling fluid inlet 26, through condenser tube bundle 10 of the second heat exchange unit 18, and into the rear water tank 32. While flowing through the condenser tube bundle 10, the cooling fluid may be in a heat exchange relationship with another fluid in the cylinder 7. Further, the second path may direct the cooling fluid from the rear water tank 32 of the second heat exchange unit 18 into the rear water tank 23 of the first heat exchange unit 16 via the return 33. Accordingly, the cooling fluid that flows through the second heat exchange unit 18 may also flow through the second pass of the condenser tube bundle 5, such that the cooling fluid is also placed in a heat exchange relationship with the fluid in the cylinder 1 of the first heat exchange unit 16 (e.g., after mixing with the cooling fluid flowing through the first heat exchange unit 16 in the rear water tank 23 of the first heat exchange unit 16). The cooling fluid may then be directed into the front water tank 22 of the first heat exchange unit 16 and discharged from the outlet 25.

Additionally, the chilled fluid may enter the front water tank 31 of the second heat exchange unit 18 from the chilled fluid inlet 27. The chilled fluid may then flow through a first pass an evaporation tube bundle 13 and into the rear water tank 32 of the second heat exchange unit 18. Accordingly, the chilled fluid may also be placed in a heat exchange relationship with the fluid in the cylinder 7 of the second heat exchange unit. The chilled fluid may flow from the rear water tank 32 of the second heat exchange unit through a second pass of the evaporation tube bundle 13, into the front water tank 31 of the second heat exchange unit 18, and discharged through the chilled fluid outlet 28.

Figure 4:
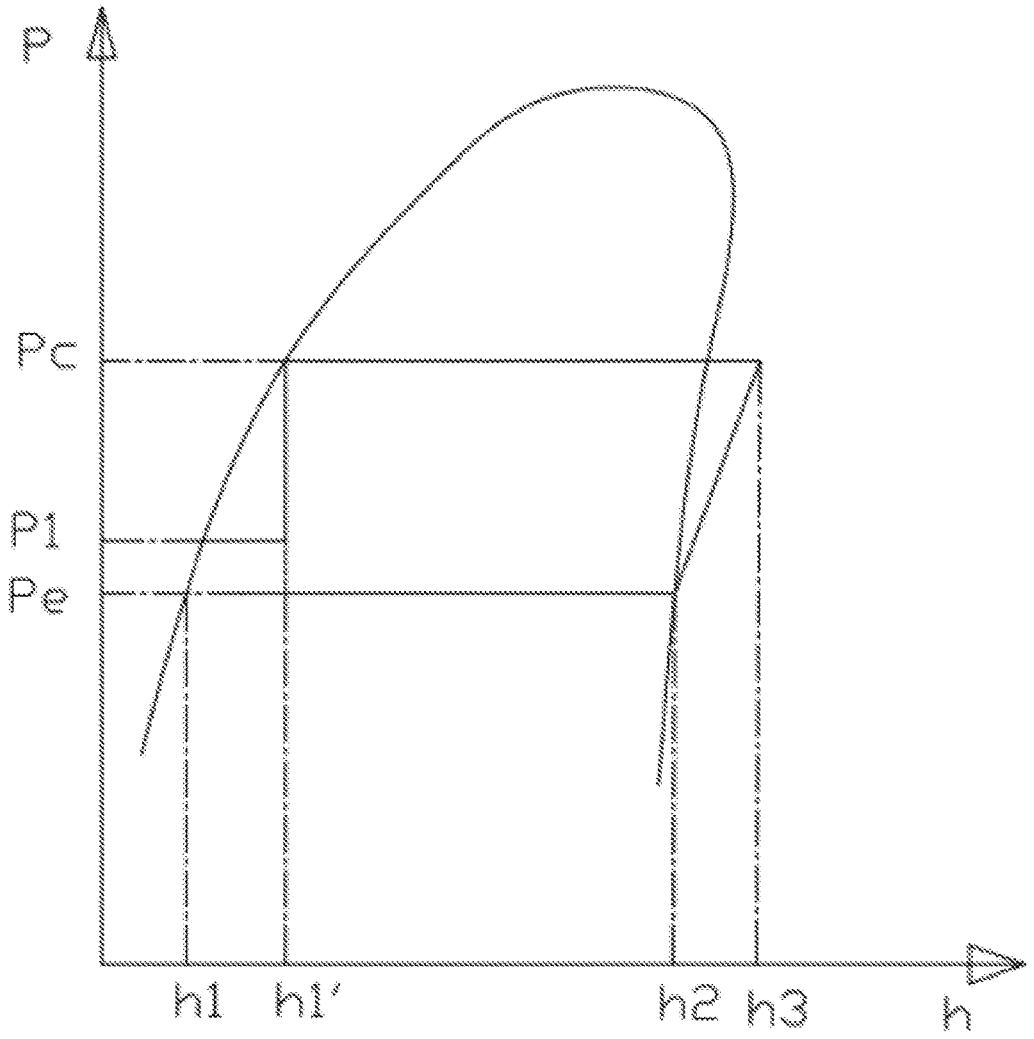
FIG. 4 is a chart of a pressure-enthalpy diagram of the heat exchange device that utilizes the two-flow path water circulation loop of FIG. 3, in accordance with an embodiment of the present disclosure.

In the embodiments of FIGS. 2-4, the first heat exchange unit 16 may operate as a condenser, such that an interior of the cylinder 1 of the first heat exchange unit 16 receives high-temperature, high-pressure refrigerant vapor from a compressor outlet port (not shown) via a refrigerant inlet 2. In some embodiments, the impingement plate 4 disposed within the cylinder 1 proximate to the refrigerant inlet 2 may block refrigerant from directly contacting the condenser tube bundle 5 when first introduced into the cylinder 1. After contacting the impingement plate 4, the refrigerant may flow around the condenser tube bundle 5 and transfer heat to the cooling fluid flowing through the condenser tube bundle 5. Thus, the refrigerant may be condensed into a high pressure refrigerant liquid and flow out of the cylinder 1 via a refrigerant outlet 3. From the refrigerant outlet 3, the refrigerant may be directed into the connection conduit 17 and/or the throttling device 6. As such, the high pressure refrigerant liquid may become a medium-pressure, two-phase refrigerant. For example, a pressure difference between the refrigerant upstream of the throttling device 6 and the refrigerant downstream of the throttling device 6 may be expressed as $DP1=Pc-P1$, where DP1 is the pressure difference, Pc is the pressure of the refrigerant upstream of the throttling device 6, and P1 is the pressure of the refrigerant downstream of the throttling device 6 (see, e.g., FIG. 4).

After flowing through the throttling device 6, the medium-pressure, two-phase refrigerant may enter an interior of the cylinder 7 of the second heat exchange unit 18 through a refrigerant inlet 8 of the second heat exchange unit 18. In some embodiments, the impingement plate 11 disposed within the cylinder 7 proximate to the refrigerant inlet 8 may block the medium-pressure, two-phase refrigerant from directly contacting the condenser tube bundle 10 when first introduced into the cylinder 7. Additionally, a cavity may be included between the condenser tube bundle 10 and the refrigerant inlet 8 to facilitate a uniform distribution of the refrigerant around the condenser tube bundle 10. The medium-pressure, two-phase refrigerant may become a medium-pressure, saturated liquid refrigerant after flowing through the condenser tube bundle 10. For example, the medium-pressure, two-phase refrigerant may condense upon transferring heat to the cooling fluid flowing through the condenser tube bundle 10. The medium-pressure, saturated liquid refrigerant may then uniformly drip onto the refrigerant dispenser 14.

In some embodiments, a difference between enthalpy of the refrigerant upstream of the condenser tube bundle 10 and the refrigerant downstream of the condenser tube bundle 10 may be expressed as $DH=h1'-h1$, where DH is the enthalpy difference, h1' is the enthalpy of the refrigerant upstream of the condenser tube bundle 10 and h1 is the enthalpy of the refrigerant downstream of the condenser tube bundle 10

(see, e.g., FIG. 4). The enthalpy difference, DH, may quantify an amount of system capacity increased by including the condenser tube bundle 10.

In any case, the medium-pressure, saturated liquid refrigerant may become a low-pressure, two-phase refrigerant after passing through the refrigerant dispenser 14 as a result of further pressure reduction of the refrigerant as it passes through the refrigerant dispenser 14. For example, a difference between the pressure (DP2) of the refrigerant upstream of the refrigerant dispenser 14 (P1) and downstream of the refrigerant dispenser 14 (Pe) and after the refrigerant dispenser is DP2=P1−Pe (see, e.g., FIG. 4). Accordingly, the low-pressure, two-phase refrigerant may uniformly drip over the evaporation tube bundle 13 and accumulate at a lower portion of the second heat exchange unit 18. The accumulated, low-pressure, two-phase refrigerant may then evaporate and become a low-temperature, low-pressure refrigerant vapor as it absorbs heat from the chilled fluid flowing through the evaporation tube bundle 13. The low-temperature, low-pressure refrigerant vapor may then be directed to the gas returning chamber 15 via the opening 20. From the opening, the low-temperature, low-pressure refrigerant vapor may be returned to a compressor suction port through the refrigerant outlet 9 of the second heat exchange unit 18. The liquid baffle 12 may block the refrigerant liquid from being sucked into the refrigerant outlet 9 of the second heat exchange unit 18.

Embodiment 2

FIG. 5 is a schematic of another embodiment of a two-flow path water circulation loop. As shown in the illustrated embodiment of FIG. 5, the first heat exchange unit 16 further includes the tube plates 21, the front water tank 22, and the rear water tank 23 that are disposed at the ends of the cylinder 1 of the first heat exchange unit 16. The front water tank 22 is provided with the inlet 24 and the outlet 25. Further, the pass partition plate 34 is disposed inside the front water tank 22 to partition the inlet 24 from the outlet 25 and to enable the cooling fluid to make two passes through the first heat exchange unit 16.

Further, the second heat exchange unit 18 further includes the tube plates 30, the front water tank 31, and the rear water tank 32 that are disposed at the ends of the cylinder 7 of the second heat exchange unit 18. The front water tank 31 is provided with two inlets 39 and a chilled fluid outlet 28. As shown in the illustrated embodiment of FIG. 5, the two inlets 39 are in fluid communication with each other through the conduit 38, and are both in fluid communication with a chilled fluid inlet 40. The partition plate 35 is disposed between a first inlet 39 and the chilled fluid outlet 28 to block the chilled fluid entering the front water tank 31 from mixing with the chilled fluid exiting through the chilled fluid outlet 28. Additionally, the pass partition plate 36 is disposed between a second inlet 39 and the chilled fluid outlet 28 to block the chilled fluid entering the front water tank 31 from exiting through the chilled fluid outlet 28.

The chilled fluid flowing through the chilled fluid inlet 40 is divided into two paths through the conduit 38. The first path of the chilled fluid may direct the chilled fluid into the front water tank 31 from the first inlet 39, through the condenser tube bundle 10 of the second heat exchange unit 18, and into the rear water tank 32. Accordingly, the chilled fluid may be placed in heat exchange relationship with the refrigerant flowing through the cylinder 7 of the second heat exchange unit 18.

The second path of the chilled fluid may direct the chilled fluid into the front water tank 31 from the second inlet 39, through a first pass of the evaporation tube bundle 13, and into the rear water tank 32. Therefore, the chilled fluid of the second path may also be placed in a heat exchange relationship with the refrigerant flowing through the cylinder 7. In the rear water tank 32, the chilled fluid from the condenser tube bundle 10 and the first pass of the evaporation tube bundle 13 may combine with one another. The combined chilled fluid may then flow from the rear water tank 32, through a second pass of the evaporation tube bundle 13, into the front water tank 31, and is discharged through the chilled fluid outlet 28.

The cooling fluid enters the front water tank 22 of the first heat exchange unit 16 from the inlet 24, flows through a first pass of the condenser tube bundle 5, and into the rear water tank 23 of the first heat exchange unit 16. Accordingly, the cooling fluid is placed in a heat exchange relationship with the refrigerant within the cylinder 1 of the first heat exchange unit 15. The cooling fluid in the rear water tank 23 is then directed into a second pass of the condenser tube bundle 5, into the front water tank 22, and discharged through the outlet 25. The cooling fluid is then placed in another heat exchange relationship with the refrigerant in the cylinder 1 when flowing through the second pass of the condenser tube bundle 5.

In the embodiments of FIGS. 2, 5, and 6, the first heat exchange unit 16 may operate as a condenser, such that an interior of the cylinder 1 of the first heat exchange unit 16 receives high-temperature, high-pressure refrigerant vapor from a compressor outlet port (not shown) via a refrigerant inlet 2. In some embodiments, the impingement plate 4 disposed within the cylinder 1 proximate to the refrigerant inlet 2 may block refrigerant from directly contacting the condenser tube bundle 5 when first introduced into the cylinder 1. After contacting the impingement plate 4, the refrigerant may flow around the condenser tube bundle 5 and transfer heat to the cooling fluid flowing through the condenser tube bundle 5. Thus, the refrigerant may be condensed into a high pressure refrigerant liquid and flow out of the cylinder 1 via a refrigerant outlet 3. From the refrigerant outlet 3, the refrigerant may be directed into the connection conduit 17 and/or the throttling device 6. As such, the high pressure refrigerant liquid may become a medium-pressure, two-phase refrigerant. For example, a pressure difference between the refrigerant upstream of the throttling device 6 and the refrigerant downstream of the throttling device 6 may be expressed as DP1_2=Pc−P1_2, where DP1_2 is the pressure difference, Pc is the pressure of the refrigerant upstream of the throttling device 6, and P1_2 is the pressure of the refrigerant downstream of the throttling device 6 (see, e.g., FIG. 6).

After flowing through the throttling device 6, the medium-pressure, two-phase refrigerant may enter an interior of the cylinder 7 of the second heat exchange unit 18 through a refrigerant inlet 8 of the second heat exchange unit 18. In some embodiments, the impingement plate 11 disposed within the cylinder 7 proximate to the refrigerant inlet 8 may block the medium-pressure, two-phase refrigerant from directly contacting the condenser tube bundle 10 when first introduced into the cylinder 7. Additionally, a cavity may be included between the condenser tube bundle 10 and the refrigerant inlet 8 to facilitate a uniform distribution of the refrigerant around the condenser tube bundle 10. The medium-pressure, two-phase refrigerant may become a medium-pressure, saturated liquid refrigerant after flowing over the condenser tube bundle 10. For example, the medium-pressure, two-phase refrigerant may condense upon transferring heat to the chilled fluid flowing through the condenser tube bundle 10. The medium-pressure, saturated liquid refrigerant may then uniformly drip onto the refrigerant dispenser 14.

In some embodiments, a difference between enthalpy of the refrigerant upstream of the condenser tube bundle 10 and the refrigerant downstream of the condenser tube bundle 10 may be expressed as DH_2=h1'−h1_2, where DH_2 is the enthalpy difference, h1' is the enthalpy of the refrigerant upstream of the condenser tube bundle 10 and h1_2 is the enthalpy of the refrigerant downstream of the condenser tube bundle 10 (see, e.g., FIG. 6). The enthalpy difference, DH, may quantify an amount of system capacity increased by including the condenser tube bundle 10.

In any case, the medium-pressure, saturated liquid refrigerant may become a low-pressure, two-phase refrigerant after passing through the refrigerant dispenser 14 as a result of further pressure reduction of the refrigerant as it passes through the refrigerant dispenser 14. For example, a difference between the pressure (DP2_2) of the refrigerant upstream of the refrigerant dispenser 14 (P1_2) and downstream of the refrigerant dispenser 14 (Pe) and after the refrigerant dispenser is DP2_2=P1_2−Pe (see, e.g., FIG. 6). Accordingly, the low-pressure, two-phase refrigerant may uniformly drip over the evaporation tube bundle 13 and accumulate at a lower portion of the second heat exchange unit 18. The accumulated, low-pressure, two-phase refrigerant may then evaporate and become a low-temperature, low-pressure refrigerant vapor as it absorbs heat from the chilled fluid flowing through the evaporation tube bundle 13. The low-temperature, low-pressure refrigerant vapor may then be directed to the gas returning chamber 15 via the opening 20. From the opening, the low-temperature, low-pressure refrigerant vapor may be returned to a compressor suction port through the refrigerant outlet 9 of the second heat exchange unit 18. The liquid baffle 12 may block the refrigerant liquid from being sucked into the refrigerant outlet 9 of the second heat exchange unit 18.

Compared with the embodiment illustrated in FIGS. 3 and 4, the heat exchange system of FIGS. 5 and 6 are relatively simple. For example, the chilled fluid may flow through the condenser tube bundle 10 at a lower temperature when compared to the cooling fluid flowing through the condenser tube bundle 10. Therefore, the pressure difference DP1_2 between the refrigerant upstream of the throttling device 6 and downstream of the throttling device 6 may be increase, which may enhance an efficiency of the system. At the same time, the enthalpy difference DH_2 between the refrigerant upstream of the condenser tube bundle 10 and downstream of the condenser tube bundle 10 may also be increased, thereby increasing a capacity of the overall system.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out the embodiments of the present disclosure, or those unrelated to enabling the claimed disclosure). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heat exchange device for a low pressure refrigerant, comprising:

a first heat exchange unit comprising a first condenser tube bundle disposed within a first cylinder of the first heat exchange unit; and a second heat exchange unit comprising a liquid baffle and a refrigerant dispenser disposed in a second cylinder of the second heat exchange unit, wherein a first refrigerant outlet of the first heat exchange unit is in fluid communication with a first refrigerant inlet of the second heat exchange unit through a throttling device, the liquid baffle extends along an axial direction of the second cylinder to form a piping chamber and a gas returning chamber, the refrigerant dispenser is disposed in the piping chamber, the refrigerant dispenser extends from the liquid baffle toward an inner surface of the second cylinder and extends along the axial direction of the second cylinder to form an upper portion and a lower portion of the piping chamber, a second condenser tube bundle is disposed in the upper portion of the piping chamber, and an evaporation tube bundle is disposed in the lower portion of the piping chamber.

2. The heat exchange device of claim 1, wherein the first heat exchange unit comprises a second refrigerant inlet and the first refrigerant outlet, and wherein the second heat exchange unit comprises the first refrigerant inlet and a second refrigerant outlet.

3. The heat exchange device of claim 2, comprising a first impingement plate disposed between the first condenser tube bundle of the first heat exchange unit and the second refrigerant inlet and a second impingement plate disposed between the second condenser tube bundle of the second heat exchange unit and the first refrigerant inlet.

4. The heat exchange device of claim 2, wherein the second refrigerant outlet is in fluid communication with the gas returning chamber, and wherein the first refrigerant inlet is in fluid communication with the upper portion of the piping chamber.

5. The heat exchange device of claim 1, wherein the first heat exchange unit comprises first tube plates, a first front water tank, and a first rear water tank that are disposed at first ends of the first cylinder of the first heat exchange unit, wherein the first front water tank is provided with a first inlet and a first outlet, and wherein a first pass partition plate is disposed within the first front water tank to partition the first inlet from the first outlet.

6. The heat exchange device of claim 5, wherein the second heat exchange unit comprises second tube plates, a second front water tank, and a second rear water tank that are disposed at second ends of the second cylinder of the second heat exchange unit, wherein the second front water tank is provided with a second inlet, a chilled fluid inlet, and a chilled fluid outlet, wherein a front water tank partition plate that blocks cooling fluid from mixing with chilled fluid is disposed between the second inlet and the chilled fluid outlet, wherein a second pass partition plate is disposed between the chilled fluid inlet and the chilled fluid outlet, and wherein a rear water tank partition plate that blocks the cooling fluid from mixing with the chilled fluid is disposed within the second rear water tank.

7. The heat exchange device of claim 6, wherein the second inlet of the second heat exchange unit is in fluid communication with the first inlet of the first heat exchange unit through a conduit, and wherein the second rear water tank of the second heat exchange unit comprises a return in fluid communication with the first rear water tank of the first heat exchange unit.

8. The heat exchange device of claim 5, wherein the second heat exchange unit comprises second tube plates, a second front water tank, and a second rear water tank that are disposed at second ends of the second cylinder of the second heat exchange unit, wherein the second front water tank is provided with a first chilled fluid inlet, a second chilled fluid inlet, and a chilled fluid outlet, wherein a front water tank partition plate is disposed between the first chilled fluid inlet and the chilled fluid outlet, and wherein a second pass partition plate is disposed between the second chilled fluid inlet and the chilled fluid outlet.

9. The heat exchange device of claim 8, wherein chilled fluid from the first chilled fluid inlet and chilled fluid from the second chilled fluid inlet combine in the second rear water tank before discharging from the second heat exchange unit through the chilled water outlet.

10. A method for using a heat exchange device, comprising:

receiving a refrigerant vapor discharged from a compressor outlet port in a first cylinder of a first heat exchange unit via a first refrigerant inlet;

condensing the refrigerant vapor into a refrigerant liquid after passing the refrigerant vapor over a first condenser tube bundle disposed in the first cylinder of the first heat exchange unit;

directing the refrigerant liquid through a first refrigerant outlet of the first heat exchange unit into a connection conduit coupled to a second refrigerant inlet of a second heat exchange unit;

receiving the refrigerant liquid in a second cylinder of the second heat exchange unit via the second refrigerant inlet;

condensing the refrigerant liquid into a saturated refrigerant liquid after passing the refrigerant liquid over a second condenser tube bundle of the second heat exchange unit;

directing the saturated refrigerant liquid through a refrigerant dispenser disposed within the second cylinder of the second heat exchange unit, such that the saturated refrigerant liquid becomes a two-phase refrigerant; and evaporating the two-phase refrigerant into the refrigerant vapor after passing the two-phase refrigerant over an evaporation tube bundle disposed in the second cylinder of the second heat exchange unit.

11. The method of claim 10, comprising directing the low-pressure refrigerant vapor to a compressor suction port via a second refrigerant outlet of the second heat exchange unit.

12. The method of claim 10, comprising directing the liquid refrigerant through a throttling device disposed along the connection conduit to expand the liquid refrigerant before the liquid refrigerant is received in the second cylinder of the second heat exchange unit.

13. The method of claim 10, comprising:

directing a first portion of a cooling fluid through the first condenser tube bundle disposed in the first heat exchange unit;

directing a second portion of the cooling fluid through the second condenser tube bundle disposed in the second heat exchange unit; and directing a chilled fluid through the evaporation tube bundle disposed in the second heat exchange unit.

14. The method of claim 13, comprising combining the first portion of the cooling fluid and the second portion of the cooling fluid in a rear water tank of the first heat exchange unit.

15. The method of claim 10, comprising:

directing a cooling fluid through the first condenser tube bundle disposed in the first heat exchange unit;

directing a first portion of a chilled fluid through the second condenser tube bundle disposed in the second heat exchange unit;

directing a second portion of the chilled fluid through the evaporation tube bundle disposed in the second heat exchange unit; and combining the first portion of the chilled fluid and the second portion of the chilled fluid in a rear water tank of the second heat exchange unit.

16. A heat exchange device, comprising:

a first heat exchange unit comprising a first condenser tube bundle and a first impingement plate disposed within a first cylinder of the first heat exchange unit, wherein the first impingement plate is disposed in the first cylinder proximate to a first refrigerant inlet; and a second heat exchange unit comprising a liquid baffle, a refrigerant dispenser, a second impingement plate, a second condenser tube bundle, and an evaporation tube bundle disposed in a second cylinder of the second heat exchange unit, wherein a first refrigerant outlet of the first heat exchange unit is in fluid communication with a second refrigerant inlet of the second heat exchange unit through a throttling device, the liquid baffle extends along an axial direction of the second cylinder to form a piping chamber and a gas returning chamber, the refrigerant dispenser is disposed in the piping chamber, the refrigerant dispenser extends from the liquid baffle toward an inner surface of the second cylinder and extends along the axial direction of the second cylinder to form an upper portion and a lower portion of the piping chamber, the second condenser tube bundle is disposed in the upper portion of the piping chamber, the evaporation tube bundle is disposed in the lower portion of the piping chamber, and the second impingement plate is disposed in the second cylinder proximate to the second refrigerant inlet.

17. The heat exchange device of claim 16, wherein the first heat exchange unit comprises first tube plates, a first front water tank, and a first rear water tank that are disposed at first ends of the first cylinder of the first heat exchange unit, wherein the first front water tank is provided with a first inlet and a first outlet, and wherein a first pass partition plate is disposed within the first front water tank to partition the first inlet from the first outlet.

18. The heat exchange device of claim 17, wherein the second heat exchange unit comprises second tube plates, a second front water tank, and a second rear water tank that are disposed at second ends of the second cylinder of the second heat exchange unit, wherein the second front water tank is provided with a first chilled fluid inlet, a second chilled fluid inlet, and a chilled fluid outlet, wherein a front water tank partition plate is disposed between the first chilled fluid inlet and the chilled fluid outlet, and wherein a second pass partition plate is disposed between the second chilled fluid inlet and the chilled fluid outlet.

19. The heat exchange device of claim 17, wherein the second heat exchange unit comprises second tube plates, a second front water tank, and a second rear water tank that are disposed at second ends of the second cylinder of the second heat exchange unit, wherein the second front water tank is provided with a second inlet, a chilled fluid inlet, and a chilled fluid outlet, wherein a front water tank partition plate that blocks cooling fluid from mixing with chilled fluid is disposed between the second inlet and the chilled fluid outlet, wherein a second pass partition plate is disposed between the chilled fluid inlet and the chilled fluid outlet, and wherein a rear water tank partition plate that blocks the cooling fluid from mixing with the chilled fluid is disposed within the second rear water tank.

* * * * *